US006447312B1

(12) United States Patent
Takata

(10) Patent No.: US 6,447,312 B1
(45) Date of Patent: Sep. 10, 2002

(54) CONNECTOR AND CONNECTOR STRUCTURE

(75) Inventor: Kensaku Takata, Nagoya (JP)

(73) Assignees: Autonetworks Technologies, Ltd., Aichi; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/899,836

(22) Filed: Jul. 9, 2001

(30) Foreign Application Priority Data

Jul. 11, 2000 (JP) ..... 2000-210307

(51) Int. Cl.[7] ..... H01R 13/62
(52) U.S. Cl. ..... 439/157; 439/372
(58) Field of Search ..... 439/157–160, 439/372

(56) References Cited

U.S. PATENT DOCUMENTS 5,172,998 A * 12/1992 Hatagishi ..... 439/296
5,257,942 A 11/1993 Taguchi
5,476,390 A * 12/1995 Taguchi et al. ..... 439/157
5,482,394 A * 1/1996 Shinch et al. ..... 439/157
5,499,926 A * 3/1996 Akeda ..... 439/157
5,647,752 A 7/1997 Taguchi
6,120,308 A * 9/2000 Hayashi ..... 439/157

FOREIGN PATENT DOCUMENTS

| | | |
|---|---|---|
| EP | 0 977 324 A2 | 2/2000 |
| JP | A 11-40250 | 2/1999 |
| JP | B 2914593 | 4/1999 |

* cited by examiner

*Primary Examiner*—Renee Luebke
*Assistant Examiner*—Briggitte R. Hammond
(74) *Attorney, Agent, or Firm*—Oliff & Berridge PLC

(57) ABSTRACT

A structure of mounting a lever 30 on a body housing 20 includes pivotal movement support portions 28, having a cross-sectional shape other than a round shape, and intrusion grooves 36, into which said pivotal movement support portions 28 can intrude, respectively, only at a predetermined angle, and fitting holes 37 (which are provided respectively at inner ends of the intrusion grooves) in which said pivotal movement support portions 28 can be rotated, respectively. The body housing 20 has guide surfaces 26*a* for guiding the lever 30 in the pivotally-moving direction thereof.

20 Claims, 7 Drawing Sheets

CONNECTOR AND CONNECTOR STRUCTURE

BACKGROUND OF THE INVENTION

1. [Technical Field]

This invention relates to a connector which is fitted relative to a mating connector by operating a lever, and the invention also relates to a connector structure including this connector.

2. [Related Art]

Recently, in view of a multi-pole design of connectors and so on, there have been provided various connectors of the type in which a lever is pivotally mounted on a body housing so as to reduce an operating force required for an fitting operation, and the body housing can be fitted relative to a mating connector with the low operating force, utilizing leverage of this lever.

For example, the Japanese Patent No. 2914593 discloses one conventional structure for mounting such a lever on a body housing, in which support pins of a round cross-section are formed on and project from opposite (right and left) side surfaces of the body housing, respectively, and round pivot holes for respectively fitting on the support pins are formed in opposite (right and left) ends of the U-shaped lever, and the support pins are fitted respectively in the pivot holes in the lever, so that the lever is supported for pivotal movement about the support pins.

In this structure, however, when mounting the lever, it is necessary to fit the pivot holes respectively on the support pins from the outside while spreading the lever in a manner to elastically deform the opposite (right and left) end portions of the lever outwardly away from each other, and the assembling operation is not easy. In contrast, after the mounting of the lever, there is a fear that the lever can be easily disengaged from the body housing when the opposite (right and left) end portions of the lever are forced away from each other by some force.

Therefore, in order that the lever can be easily mounted on the body housing, the Unexamined Japanese Patent Application Publication No. Hei 11-40250 discloses the type of connector in which elongate support pins are formed on and project from a body housing while introduction grooves and holes, extending respectively from inner ends of these grooves, are formed in a lever, and each of the support pins can intrude into the corresponding introduction groove only in the longitudinal direction thereof, and the whole of the support pin can be rotatably fitted in the corresponding hole. In this connector, the lever can be easily mounted on the body housing by fitting the support pins respectively into the holes through the respective introduction grooves. And besides, after the mounting of the lever, the range of pivotal operation of the lever is set to an angle range in which the longitudinal direction of each support pin does not coincides with the direction of extending of the introduction groove, and with this arrangement the support pin is positively prevented from being disengaged from the introduction groove (that is, the lever is prevented from being disengaged from the body housing).

[Problems to be Solved]

In the above structure of the Unexamined Japanese Patent Application Publication No. Hei 11-40250, the lever can be easily mounted on the body housing. On the other hand, each support pin is elongate, and this support pin is only partially in contact with the inner surface of the round hole in the peripheral direction, and therefore there is encountered a disadvantage that the supported condition of the lever is less stable as compared with the above structure of the Japanese Patent No. 2914593 in which the round support pins are fitted in the round pivot holes, respectively. Namely, the lever is liable to rattle during the pivotal movement thereof, and this leads to a possibility that the smooth operation of the lever is prevented.

SUMMARY OF THE INVENTION

With the foregoing in view, it is an object of this invention to provide a structure in which connectors are fitted together by operating a lever, and the lever can be easily mounted on a body housing, and after the mounting of the lever, the lever can be operated in a stable manner.

[Means for Solving the Problems]

The above problems have been solved by a connector of the invention comprising a body housing for fitting on a housing of a mating connector, and a lever which is mounted on the body housing so as to be pivotally operated, and includes an engagement portion for engagement with the mating connector, wherein the engagement portion is so constructed that when the lever is pivotally operated, with the engagement portion engaged with the mating connector, the housing of the mating connector and the body housing can be fitted together with a fitting force larger than a force of pivotal movement of the lever; CHARACTERIZED in that a pivotal movement support portion, having a cross-sectional shape other than a round shape, is formed on one of the body housing and the lever while an intrusion groove, into which the pivotal movement support portion can intrude only when the angle of the lever relative to the body housing is a predetermined angle, and a fitting hole, in which the whole of the pivotal movement support portion can be rotatably fitted, are formed in the other of the body housing and the lever, the fitting hole being provided at an inner end of the intrusion groove; and the lever is pivotally supported on the body housing, with the pivotal movement support portion fitted in the fitting hole; and the range of pivotal operation of the lever is so determined that the pivotal movement support portion can not move back from the fitting hole into the intrusion groove in the range of pivotal movement of the lever; and a guide portion for guiding the lever in the pivotally-moving direction thereof is provided at the body housing.

In this construction, the pivotal movement support portion, provided at one of the body housing and the lever, is caused to intrude into the intrusion groove, formed in the other, with the lever held at the predetermined angle relative to the body housing, and is introduced into the fitting hole formed at the inner end of this intrusion groove. Thereafter, the lever is suitably rotated about the pivotal movement support portion, so that the lever can be easily mounted on the body housing.

The pivotal movement support portion has a cross-sectional shape other than a round shape, and the pivotal movement support portion contacts part of the inner peripheral surface of the fitting hole in the circumferential direction. However, the lever is guided in the pivotally-moving direction thereof by the guide portion provided at the body housing, and therefore the stable pivotal movement of the lever is achieved.

Preferably, the guide portion has an arcuate guide surface lying on a circle having the center thereof disposed on an axis of pivotal movement of the lever, and a guided portion for sliding movement on the guide surface is provided at the lever. With this construction, the lever is positively guided in the pivotally-moving direction thereof by the sliding movement of the guided portion on the guide surface.

Preferably, the guided portion has an arcuate guided surface conforming to the guide surface. With this construction, the area of contact between the guide surface and the guided portion is increased, so that the pivotal movement of the lever can be made more stable.

Preferably, an insertion portion, into which the guided portion can be inserted in a direction parallel to a direction of intrusion of the pivotal movement support portion into the intrusion groove, is provided at the body housing, and at least part of an inner surface of the insertion portion forms the guide surface.

With this construction, the guided portion of the lever is held in the insertion portion, and therefore the mounted condition of the lever is more stable, and the guided portion and the guide surface are disposed within the insertion portion, and therefore are protected from the exterior of the connector. And besides, in this construction, merely by inserting the guided portion of the lever into the insertion portion in the predetermined direction, the lever can be mounted on the body housing.

The portion, at which the insertion portion is provided, is not limited. However, in the case where the body housing includes a terminal holding portion, holding connector terminals, and a hood portion surrounding the terminal holding portion, the insertion portion is preferably formed between the terminal holding portion and the hood portion. With this construction, the body housing does not need to be increased in size, and a space between the terminal holding portion and the hood portion can be utilized efficiently.

In the invention, the lever has an arcuate guided surface lying on a circle having the center thereof disposed on an axis of pivotal movement of the lever, and the guide portion is provided at such a position that the guide portion is disposed in sliding contact with the guided surface during the pivotal movement of the lever. With this construction, also, the lever can be guided in the pivotally-moving direction thereof.

The shape of the pivotal movement support portion and the shapes of the intrusion groove and fitting hole are not particularly limited. However, preferably, the pivotal movement support portion has an elongate shape, and a width of the intrusion groove is larger than a transverse direction of the pivotal movement support portion, and is smaller than a longitudinal dimension of the pivotal movement support portion, and the fitting hole has a diameter substantially equal to the longitudinal dimension, and in the range of pivotal operation of the lever, the direction of the longitudinal dimension does not coincide with a direction of extending of the intrusion groove.

Preferably, the lever includes, for example, an operating portion, operated for pivotal movement, and a pair of right and left mounting portions which extend continuously from this operating portion, and are pivotally mounted on the body housing. The pivotal movement support portion is formed on one of the mounting portion and the body housing while the intrusion groove and the fitting hole are formed in the other.

According to another aspect of the invention, there is provided a connector structure comprising a connector as defined in any one of claims 1 to 7, and a mating connector which includes a housing for fitting in a body housing of the connector, and an engagement portion for engagement with an engagement portion of the lever, and the engagement portions are so constructed that when the lever is pivotally operated, with the two engagement portions engaged with each others, the housing of the mating connector and the body housing can be fitted together with a fitting force larger than a force of pivotal movement of the lever.

DETAILED DESCRIPTION OF THE PREFERRED EMBODIMENTS

[Mode for Carrying Out the Invention]

A first embodiment of the present invention will now be described with reference to FIGS. 1 to 8.

Figure 1:
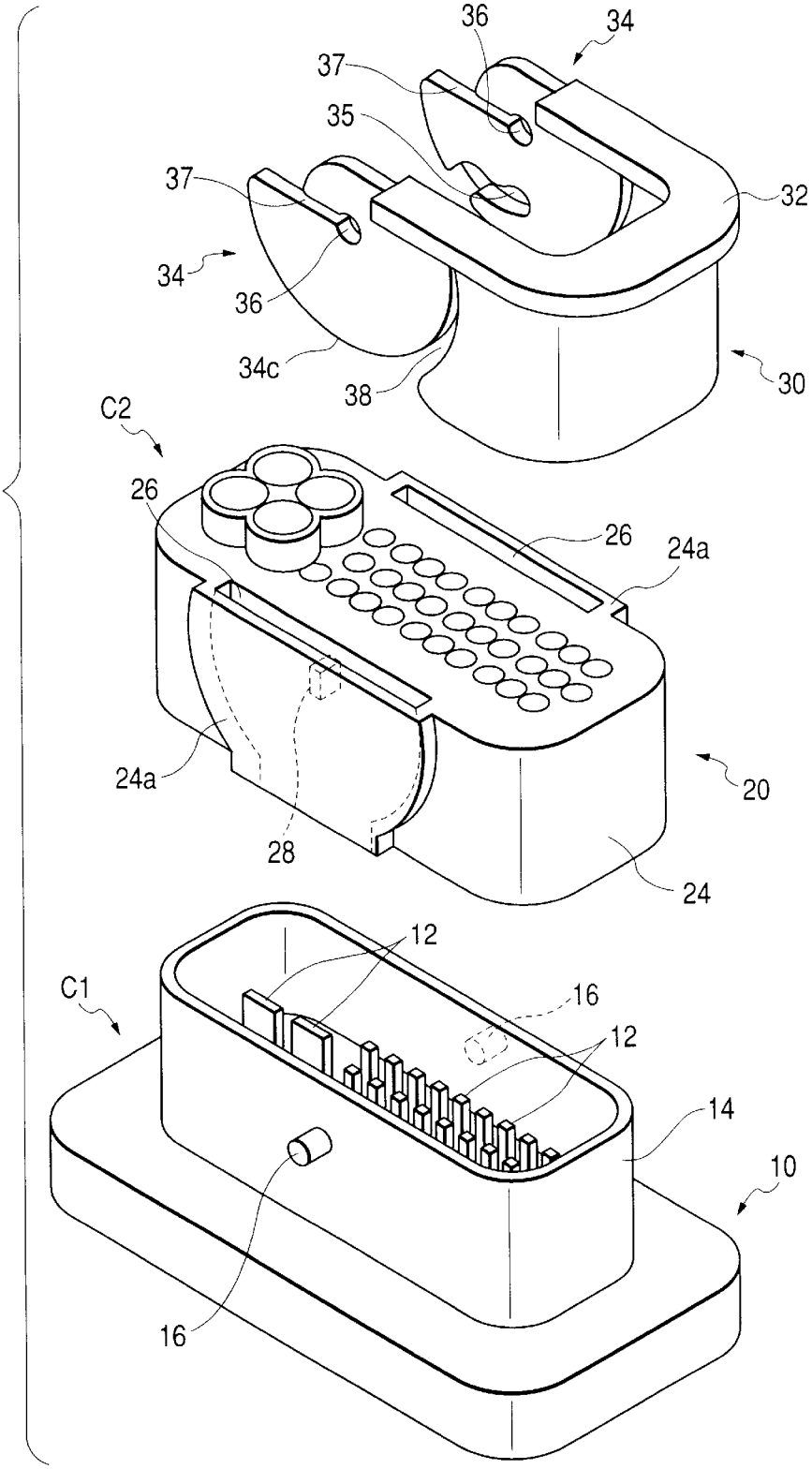
FIG. 1 is an exploded, perspective view of a first embodiment of a connector structure of the invention.

A connector structure, shown in FIG. 1, comprises a first connector (mating connector) C1, and a second connector (connector of the invention) C2, and the two connectors C1 and C2 can be fitted together.

The first connector C1 includes a housing 10 made of a resin, and many metal terminals 12 are held on this housing 10, and project upwardly (in FIG. 1). A hood portion 14, covering the terminals 12, is formed integrally with the housing 10, and outwardly-directed cam projections 16 are formed respectively on opposite (right and left) outer side surfaces of the hood portion 14.

The second connector C2 includes a body housing 20 made of a resin, and an operating lever 30 to be mounted on this body housing.

Figure 2A:
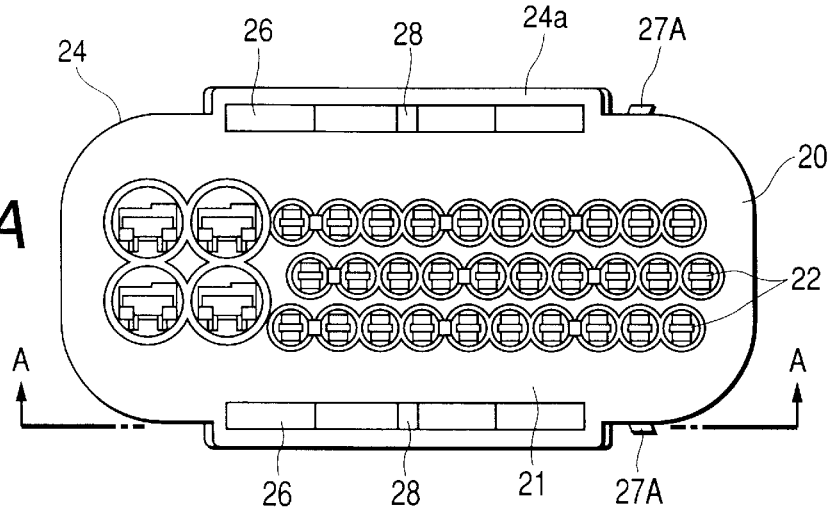
FIG. 2A is a plan view of a body housing of a second connector of the connector structure.
Figure 2B:
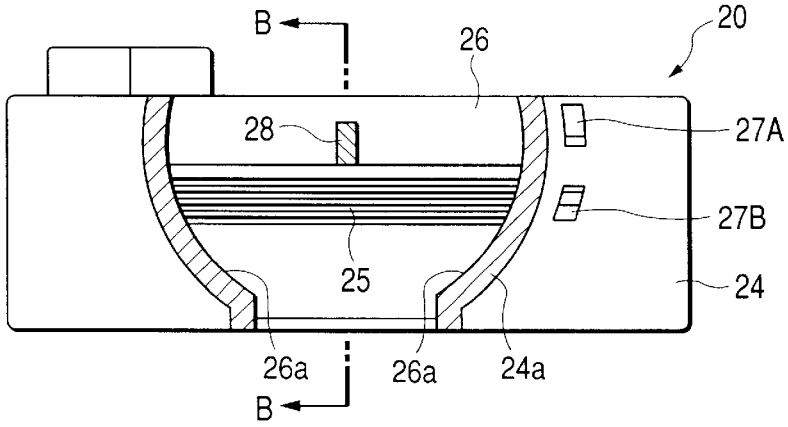
FIG. 2B is a cross-sectional view taken along the line A—A of FIG. 2A.
Figure 2C:
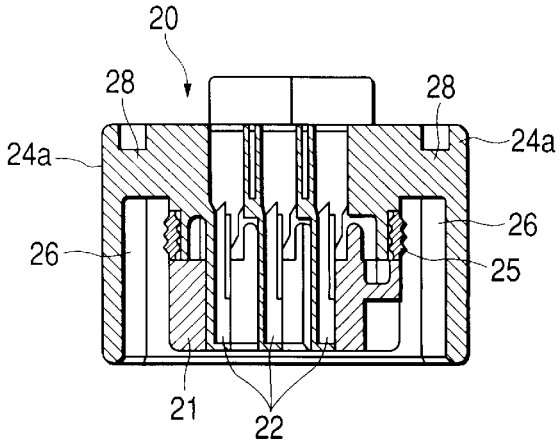
FIG. 2C is a cross-sectional view taken along the line B—B of FIG. 2B.
Figure 3A:
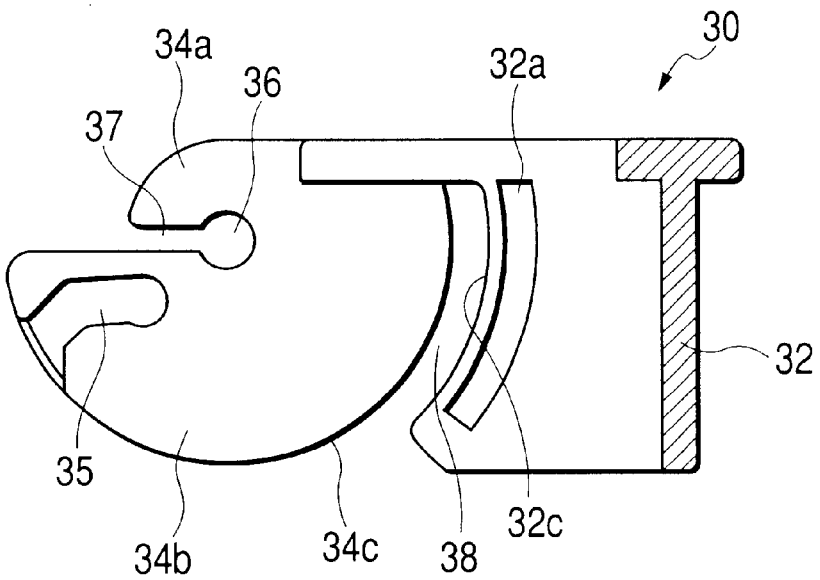
FIG. 3A is a cross-sectional, front-elevational view of a lever of the second connector.
Figure 3B:
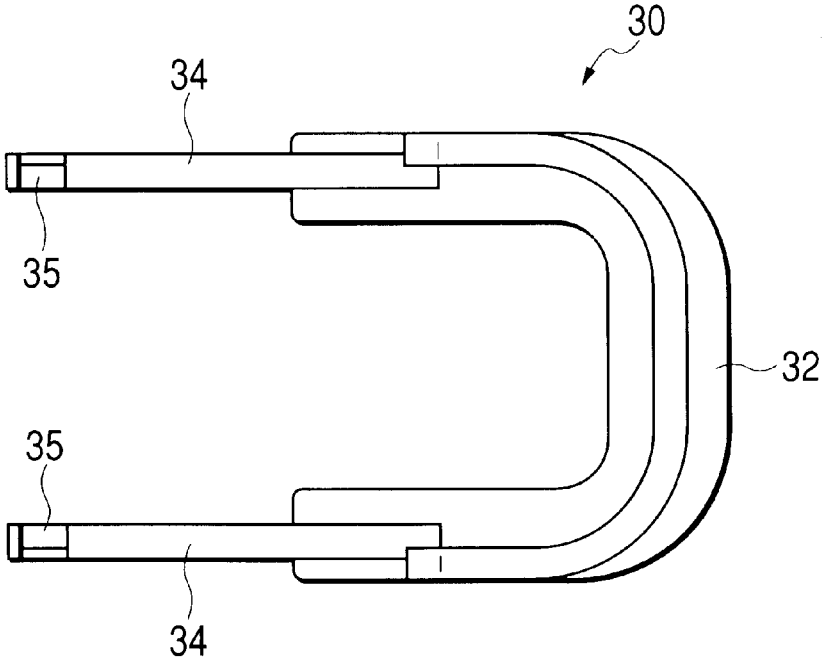
FIG. 3B is a bottom view thereof.
Figure 4:
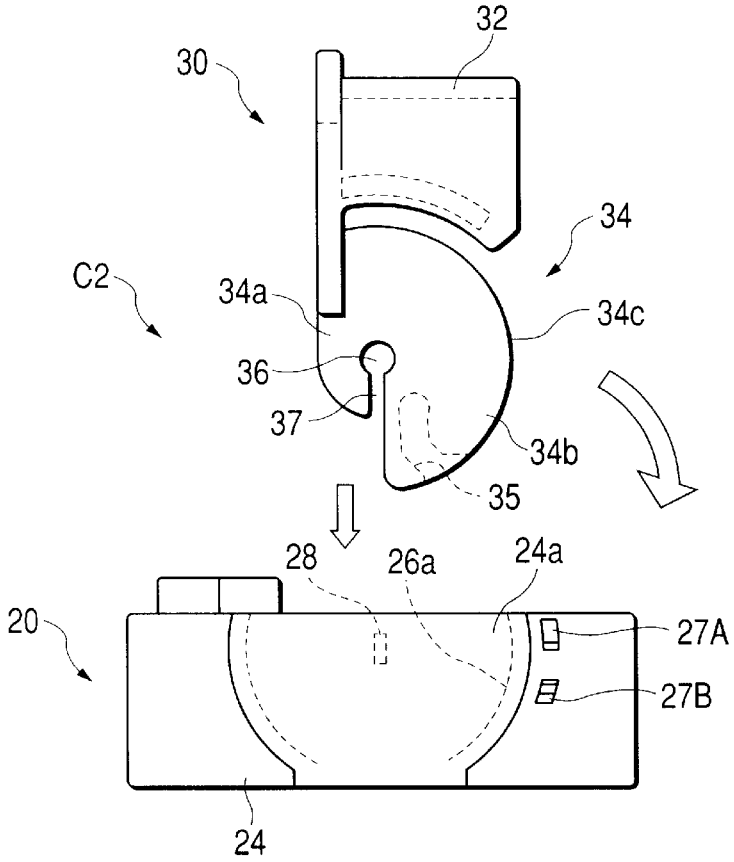
FIG. 4 is a front-elevational view showing the manner of mounting the lever on the body housing of the second connector.

As shown in FIG. 2, the body housing 20 of an integral construction includes a terminal holding portion 21, holding many metal terminals 22 (FIG. 2C), and a hood portion 24 surrounding this terminal holding portion, and the terminal holding portion 21 and the hood portion 24 are interconnected at an upper portion of the housing. The terminals 22 can be fitted respectively on the terminals 12 in the first (mating) connector C1, and the terminal holding portion 21 can be fitted into the hood portion 14 (In other words, the hood portion 14 of the first connector C1 can be fitted into a space between the terminal holding portion 21 and the hood portion 24).

A waterproof seal member 25, made of rubber, is fixedly secured to an outer peripheral surface of the terminal holding portion 21, and can contact an inner peripheral surface of the mating hood portion 14.

Bulge portions 24*a,* which bulge outwardly, are formed respectively on opposite (right and left) side surfaces of the hood portion 24. An insertion groove (insertion portion) 26 is formed between each of the bulge portions 24*a* and the terminal holding portion 21. A pivotal movement support portion 28 is formed at an upper portion of each insertion groove 26, and interconnects the terminal holding portion 21 and the hood portion 24 (that is, the bulge portion 24*a*) which are disposed respectively on the inner side and outer side of the insertion groove 26. In other words, the terminal holding portion 21 and the hood portion 24 are spaced from each other except at those regions where the pivotal movement support portions 28 are formed, and those portions, which are open upwardly, form the insertion grooves 26, respectively.

Figure 5:
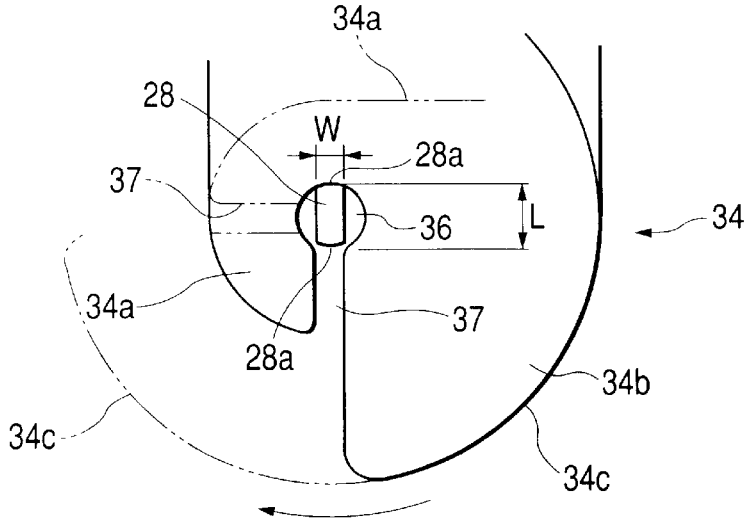
FIG. 5 is a front-elevational view showing the relation between a pivotal movement support portion, an intrusion groove and a fitting hole in the second connector.

As shown in FIG. 5, each of the pivotal movement support portions 28 has an elongate shape, and the longitudinal dimension L thereof is larger than the transverse dimension W thereof. In the illustrated example, the opposite end surfaces thereof 28*a,* spaced from each other in the longitudinal direction, have an arcuate shape, and are disposed on a circle whose center coincides with the center of the pivotal movement support portion 28.

In the invention, the terms "longitudinal dimension" and "transverse dimension" do not necessarily mean a vertical direction and a horizontal direction, respectively, in a condition of use, but merely mean the dimension of the pivotal movement support portion in the longitudinal direction and the dimension thereof in the transverse direction perpendicular to this longitudinal direction.

Each insertion groove 26 is open at the upper and lower ends thereof, and has such a configuration that it has the largest width at the upper end thereof, and is decreasing in width gradually toward the lower end thereof. Opposite (right and left) inner side surfaces of this insertion groove are formed respectively into guide surfaces 26*a* of an arcuate shape lying on a circle having the center thereof disposed generally on the center of the pivotal movement support portion 28.

The lever 30 of an integral construction includes an operating portion 32, having a generally U-shape when viewed from the top, and a pair of parallel right and left mounting plate portions 34 extending respectively from opposite ends of this operating portion 32. Each of the mounting plate portions 34 includes a base portion 34*a*, extending from the operating portion 32, and a guided portion 34*b* of an arcuate shape formed integrally with the base portion 34*a*. A round fitting hole 36 and an intrusion groove 37 are formed through the mounting plate portion 34 in a direction of the thickness thereof at the boundary between the base portion 34*a* and the guided portion 34*b*.

The intrusion groove 37 is open to that portion of a peripheral edge of the mounting plate portion 34 facing away from the operating portion 32. A width of this intrusion groove is larger than the transverse dimension W of the pivotal movement support portion 28, and is smaller than the longitudinal dimension L thereof. The fitting hole 36 has a round shape, and has such a diameter as to be generally closely fitted on the whole of the pivotal movement support portion 28. Namely, the diameter of this fitting hole is generally equal to the longitudinal dimension L. The outer peripheral surface of the guided portion 34*b* is formed a guided surface 34*c* of an arcuate shape (semi-circular shape in the illustrated embodiment) lying on a circle having the center thereof disposed generally on the center of the fitting hole 36, the guided surface 34*c* conforming to the guide surface 26*a* of the insertion groove 26.

The intrusion groove 37 and the fitting hole 36 do not always need to be formed through the mounting plate portion 34, but may be defined respectively by recesses (each having a closed bottom) formed in the inner surface of this mounting plate portion.

Figure 6:
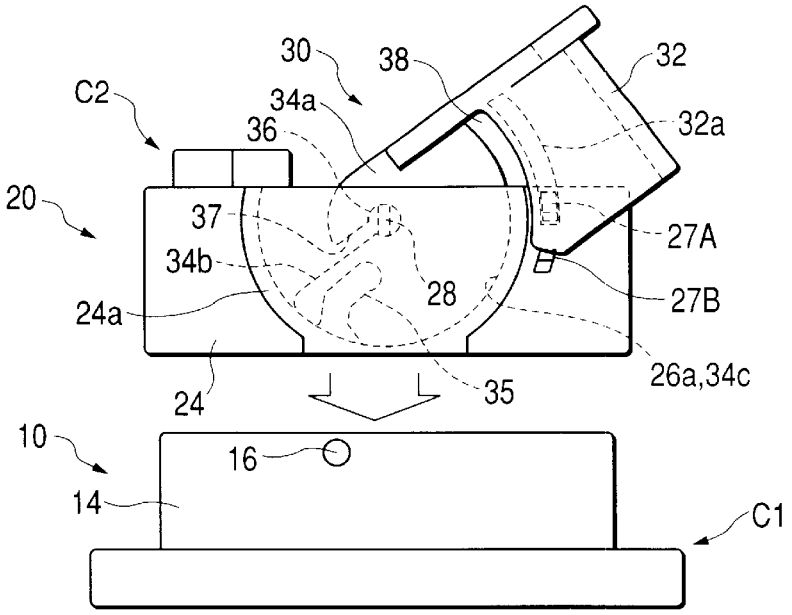
FIG. 6 is a front-elevational view showing a condition before the second connector and a first connector are fitted together.

A cam groove (engagement portion) 35 is formed in a suitable portion of the guided portion 34*b*, and extends inwardly from the outer peripheral surface thereof in a curved manner. As shown in FIG. 6, this cam groove 35 is formed at such an angular position that when the lever 30 is disposed in a pivotal movement position (hereinafter referred to as "pivotal movement initial position") where this lever is inclined at a predetermined angle relative to the body housing 20, the corresponding cam projection 16 on the first connector C1 can intrude into the cam groove 35. Further, the cam groove 35 has such a curved shape that as the lever 30 is pivotally moved toward the first connector C1 (downward in FIG. 6) in the intruded condition, a pivotally-operating force of the lever is converted into a connector fitting force (to fit the first and second connectors C1 and C2 together) larger than this pivotally-operating force. Namely, the cam groove 35 and the cam projection 16 jointly form a cam mechanism having a force-increasing function.

An arcuate notch 38 is formed between the guided surface 34*c* of the guided portion 34*b* and the operating portion 32 so as to prevent the lever from interfering with the side wall of the bulge portion 24*a* of the body housing 20. Namely, in the illustrated embodiment, that surface 32*c* of the operating portion 32, opposed to the guided surface 34*c*, is formed into an arcuate surface concentric with the guided surface 34*c*.

Figure 8:
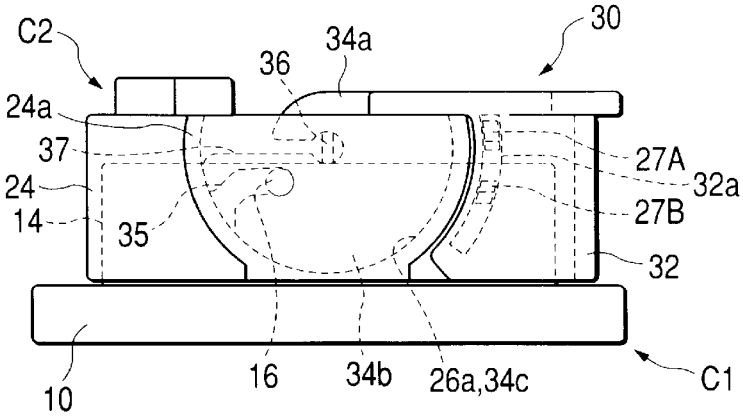
FIG. 8 is a front-elevational view showing a condition in which the fitting of the second and first connectors is completed.

The second connector C2 is provided with a mechanism which limits the range of pivotal operation of the lever 30 to an angle range from the above pivotal movement initial position to a pivotal movement finish position of FIG. 8 where the lever 30 is completely laid down relative to the body housing 20 as shown in FIG. 8. More specifically, arcuate grooves 32*a* of a channel-shaped cross-section, each lying on a circle having the center thereof disposed generally on the center of the fitting hole 36, are formed respectively in the opposed inner surfaces of the operating portion 32, and a pair of projections 27A and 27B for fitting in the corresponding channel-shaped groove 32*a* are formed on each of the outer side surfaces of the body housing 20. The positions of these projections 27A and 27B will be described later.

Next, the procedure of mounting the lever 30 on the body housing 20, as well as the procedure of connecting and disconnecting the connectors C1 and C2 relative to each other, will be described.

1) Mounting of Lever 30

First, as shown in FIG. 4A, the lever 30 is disposed in an upstanding posture (in which the open end of each intrusion groove 37 is directed downward) perpendicular to the body housing 20, and in this posture, the whole of each of the mounting plate portions 34 is inserted into the corresponding insertion groove 26 of the body housing 20 while intruding each pivotal movement support portion 28 of the body housing 20 into the corresponding intrusion groove 37. Then, at the time when the pivotal movement support portion 28 reaches the fitting hole 36, formed at the inner end of the intrusion groove 37, as shown in solid lines in FIG. 5, the lever 30 can be pivotally moved about the pivotal movement support portions 28.

Then, in this condition, the lever 30 is pivotally moved hard in a falling direction until only each projection 27A (one of the projections 27A and 27B) is fitted in a lower end portion of the corresponding channel-shaped groove 32*a* in the lever (FIG. 6). In this condition, the pivotal movement position of the lever 30 is the above pivotal movement initial position, and in this pivotal movement initial position, the lower end of the operating portion 32 of the lever 30 is held against the other projections 27B, so that the lever 30 is provisionally retained in this pivotal movement initial position. Thus, the mounting of the lever 30 on the body housing 20 is completed.

In this pivotal movement initial position, the longitudinal direction of each intrusion groove 37 in the lever 30 is inclined with respect to the longitudinal direction (upward-downward direction in the drawings) of the corresponding pivotal movement support portion 28 of the body housing 20, and therefore the pivotal movement support portion 28 will not move back into the intrusion groove 37 (that is, will not be disengaged from the fitting hole 36). Therefore, the condition of pivotally-supporting of the lever 30 by the pivotal movement support portions 28 is positively maintained.

2) Connection of Connectors C1 and C2

In the above pivotal movement initial position, the open end of each cam groove 35 is directed downward, and each cam projection 16 of the first connector C1 can intrude into the corresponding cam groove 35 through this open end. Therefore, the connectors C1 and C2 are slightly provisionally fitted together (see an arrow in FIG. 6).

3) Operation of Lever

Figure 7:
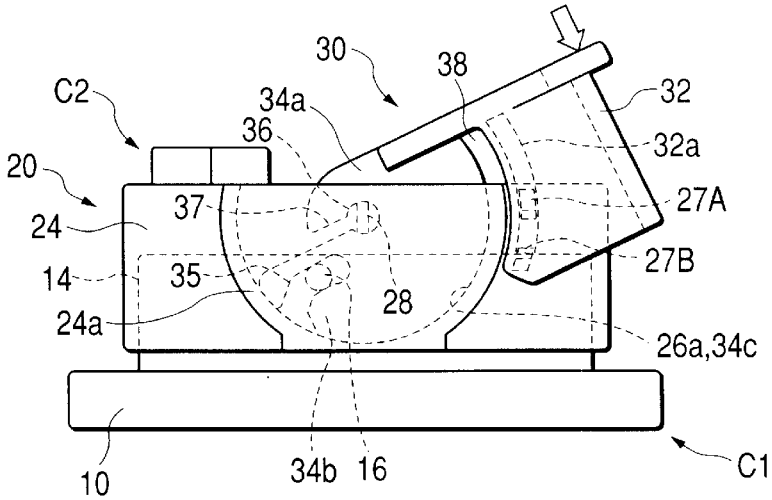
FIG. 7 is a front-elevational view showing the process of fitting the second and first connectors together.

In the above provisionally-fitted condition, a relatively-large operating force is applied to the operating portion 32 in the falling direction as indicated by an arrow in FIG. 7, thereby fitting each projection 27B into the corresponding channel-shaped groove 32*a* in which the projection 27A has already been fitted. Then, the lever 30 is further pivotally operated into the pivotal movement finish position shown in FIG. 8. During this pivotal operation of the lever 30, each cam projection 16 gradually moves along the corresponding cam groove 35 (Actually, the cam groove 35 moves), and with this cam operation, the fitting of the housing 10 of the first connector C1 relative to the body housing 20 of the second connector C2, as well as the fitting of the terminals 12 relative to the terminals 22, proceeds. Then, at the time when the lever reaches the above pivotal movement finish position, the fitting of the two connectors C1 and C2 relative to each other is completed as shown in FIG. 8.

During this operation of the lever, each pivotal movement support portion 28 contacts the inner peripheral surface of the corresponding fitting hole 36 only at the opposite longitudinal end surfaces thereof 28*a* (FIG. 5), and therefore only with these support portions, the pivotal operation of the lever 30 is liable to be unstable. However, in the illustrated second connector C2, each arcuate guided surface 34*c* of the lever 30 slide on the corresponding arcuate guide surfaces 26*a* of the body housing 20, thereby guiding the lever 30 in the pivotally-moving direction thereof, and therefore the stable pivotal operation can be effected.

And besides, in the pivotal operation range from the pivotal movement initial position to the pivotal movement finish position, the direction of the length of each pivotal movement support portion 28 is always out of agreement with the direction of the length of the intrusion groove 47, and therefore the pivotal movement support portion 28 will not be displaced from the fitting hole 36 into the intrusion groove 37.

When it is desired to disconnect the connectors C1 and C2 from each other after the above connecting operation, it is only necessary to operate the lever 30 in a direction opposite to the above-mentioned direction. At this time, also, each guided surface 34*c* of the lever 30 is guided by the guide surfaces 26*a* of the insertion groove 26, and therefore the smooth pivotal operation is ensured.

Figure 10:
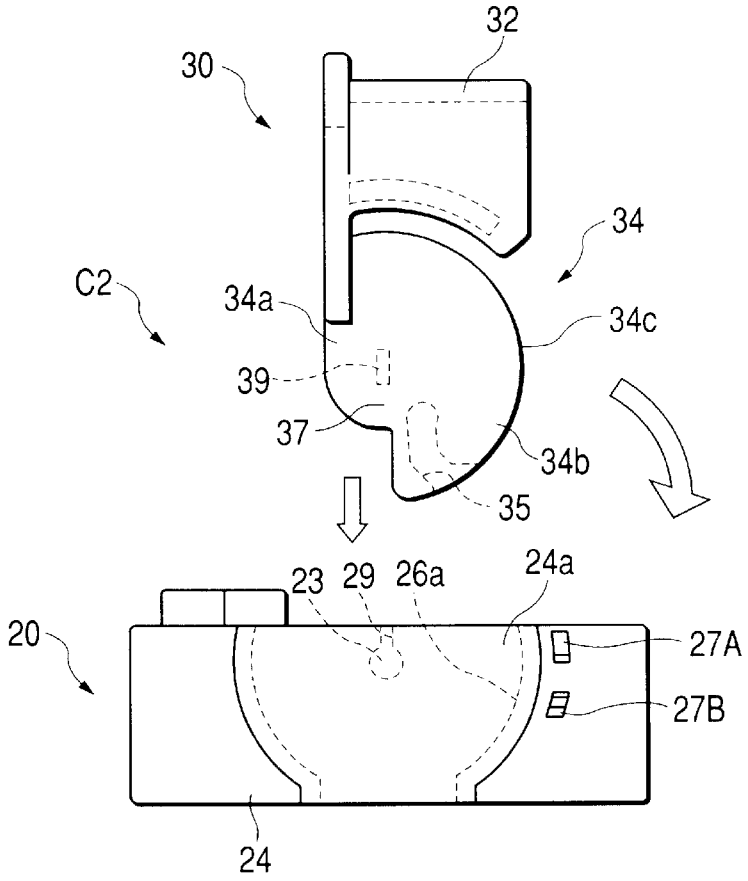
FIG. 10 is a front-elevational view showing the manner of mounting a lever on a body housing of a second connector shown in FIG. 9.
Figure 11:
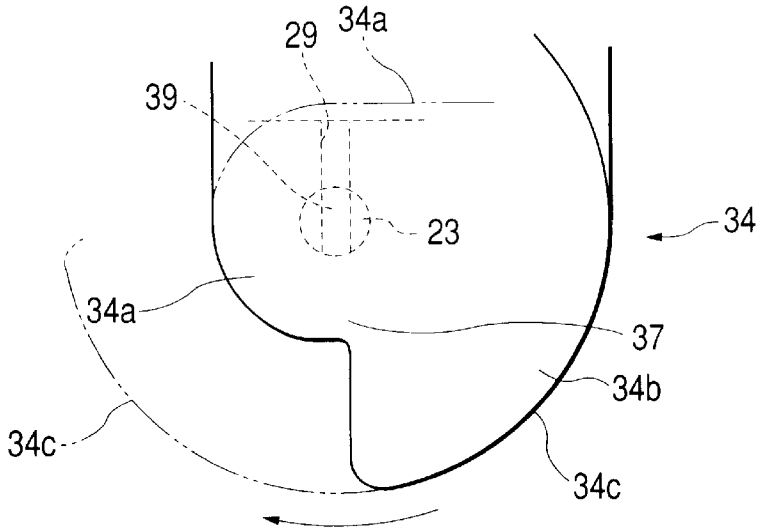
FIG. 11 is a front-elevational view showing the relation between a pivotal movement support portion, an intrusion groove and a fitting hole in the second connector of FIG. 10.

In this first embodiment, the pivotal movement support portions 28 are formed on the body housing 20 while the intrusion grooves 37 and the fitting holes 36 are formed in the lever 30. In contrast, in a second embodiment shown in FIGS. 9 to 11, a pivotal movement support portion 39 is, for example, formed on and projects from an inner surface of each projected portion 34 of a lever 30, and each intrusion groove 29 and each fitting hole 23 (formed at an inner end of this groove 29), into which the pivotal movement support portion 29 can intrude, are formed in a body housing 20 (that is, in an inner side surface of an insertion groove 26 and hence in an outer side surface of a terminal holding portion 21 in the illustrated example). With this construction, also, similar effects as described above can be obtained.

The following other forms of the invention can be adopted.

In the invention, the structure of engagement between the first connector C1 and the lever 30 may take any type in so far as the fitting force for fitting the connectors C1 and C2 together is produced by pivotally moving the lever 30 in this engaged condition. For example, there may be adopted an arrangement in which the cam projections 16 are formed on the lever 30 while the cam grooves 35 are formed in the first connector C1.

In the above embodiment, although the lever 30 is directly pivotally moved, there may be used an arrangement in which for example, a slider is mounted on the body housing 20, and can be operated to slide relative to this housing 20, and the lever can be indirectly pivotally moved by the sliding slider.

In the above embodiment, the arcuate guided surface 34*c*, conforming to the guide surfaces 26*a,* are formed on each guided portion 34*b*. However, instead, there may be provided projections or the like which serve as guided portions, and can slide on the guide surfaces 26*a*. In contrast, support projections, which serve as guide portions, and can be disposed in sliding contact with the arcuate guided surface 34*c*, may be provided at the body housing 20. However, when the arcuate guide surfaces 26*a* are formed on the body housing 20 while the guided surfaces 34*c*, conforming to the guide surfaces 26*a,* are formed on the lever 30 as in the above embodiment, the area of contact between the guide portion and the guided portion is increased, so that the operation of the lever can be made more stable.

In the above embodiment, although the outer peripheral surface of the guided portion 34*b* of the lever 30 defines the guided surface 34*c*, the guided surface may be formed by an inner peripheral surface. For example, the arcuate peripheral surface 32*c* of the operating portion 32, shown in FIG. 3A, may be used as a guided surface, in which case this guided surface is disposed in sliding contact with the outer peripheral surface of the bulge portion 24*a* (shown in FIG. 2A and others) so as to guide the lever 30.

Figure 9:
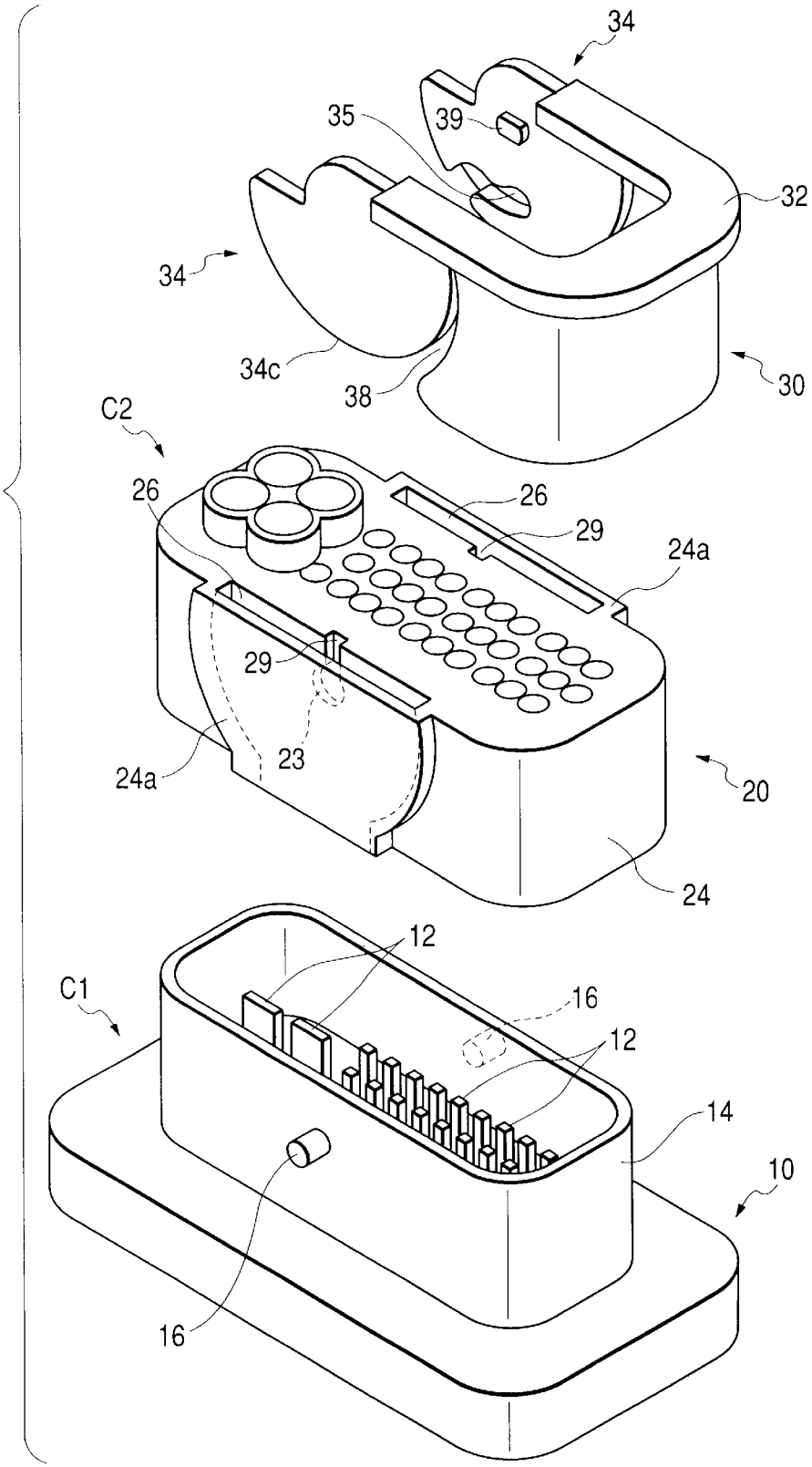
FIG. 9 is an exploded, perspective view of a second embodiment of a connector structure of the invention.

In the examples shown in FIGS. 1 and 9, the provision of the insertion grooves 26 and the bulge portions 24*a* may be omitted, in which case the pivotal movement portions 28 are merely formed respectively on the opposite side surfaces of the body housing 20, and the intrusion grooves 29 and the fitting holes 23 are merely formed in the opposite side surfaces of the body housing 20. However, with the above construction, in which the guided portions are inserted respectively in the insertion portions such as the insertion grooves 26, the mounted condition of the lever 30 can be stabilized also in the direction of the width thereof, and besides when the pivotal movement support portion is provided within the insertion portion, there is achieved an advantage that the pivotal movement support portion can be protected.

The pivotal movement support portion is not limited to the illustrated configuration, and any suitable configuration may be adopted in so far as the dimensions in longitudinal and transverse directions are suitably different from each other. For example, an oval shape, an elongated oval shape or a rectangular shape can be used.

[Effects of the Invention]

As described above, in the lever-type connector of the present invention, the pivotal movement support portions, having a cross-sectional shape other than a round shape, are formed on one of the body housing and the lever while the intrusion grooves and the fitting holes for receiving the pivotal movement support portions are formed in the other of the body housing and the lever, and the guide portions for guiding the lever in the pivotally-moving direction thereof are provided at the body housing. Therefore, with the combination of the pivotal movement support portions with the intrusion grooves and the fitting holes, advantageously, the lever can be easily mounted on the body housing, and besides the stable operation of the lever can be achieved by the guide portions provided at the body housing.

What is claimed is:

1. A connector comprising:

a body housing for fitting on a housing of a mating connector, and a lever which is mounted on said body housing so as to be pivotally operated, and includes an engagement portion for engagement with said mating connector, said engagement portion being so constructed that, when said engagement portion is engaged with said mating connector and said lever is pivotally operated, said housing of said mating connector and said body housing are fitted together with a fitting force larger than a force of pivotal movement of said lever, wherein a pivotal movement support portion, having a cross-sectional shape other than a round shape, is formed on one of said body housing and said lever;

an intrusion groove, into which said pivotal movement support portion can intrude only when an angle of said lever relative to said body housing is a predetermined angle, and a fitting hole, in which said pivotal movement support portion call be rotatably fitted, are formed in the other of said body housing and said lever, said fitting hole being provided at an inner end of said intrusion groove;

said lever is pivotally supported on said body housing, with said pivotal movement support portion fitted in said fitting hole;

a range of pivotal operation of said lever is so determined that said pivotal movement support portion does not move back from said fitting hole into said intrusion groove in said range of pivotal movement of said lever; and a guide portion for guiding said lever in the pivotally-moving direction is provided on said body housing.

2. The connector structure comprising: a connector as defined in claim 1, and a mating connector which includes a housing for fitting in a body housing of said connector and an engagement portion for engagement with an engagement portion of said lever, wherein said engagement portions are so constructed that when said lever is pivotally operated, with said two engagement portions engaged with each others, said housing of said mating connector and said body housing are be fitted together with a fitting force larger than a force of pivotal movement of said lever.

3. The connector according to claim 1, wherein said guide portion has an arcuate guide surface lying on a circle having a center thereof disposed on an axis of pivotal movement of said lever, and a guided portion for sliding movement on said guide surface is provided at said lever.

4. The connector according to claim 3, wherein said pivotal movement support portion has an elongate shape, a width of said intrusion groove is larger than a transverse direction of said pivotal movement support portion, and is smaller than a longitudinal dimension of said pivotal movement support portion, said fitting hole has a diameter substantially equal to said longitudinal dimension, and in said range of pivotal operation of said lever, the direction of said longitudinal dimension does not coincide with a direction of extending of said intrusion groove.

5. The connector structure comprising: a connector as defined in claim 3, and a mating connector which includes a housing for fitting in a body housing of said connector and an engagement portion for engagement with an engagement portion of said lever, wherein said engagement portions are so constructed that when said lever is pivotally operated, with said two engagement portions engaged with each others, said housing of said mating connector and said body housing are be fitted together with a fitting force larger than a force of pivotal movement of said lever.

6. The connector according to claim 3, wherein said guided portion has an arcuate guided surface conforming to said guide surface.

7. The connector according to claim 6, wherein an insertion portion, into which said guided portion is inserted in a direction parallel to a direction of intrusion of said pivotal movement support portion into said intrusion groove, is provided at said body housing, and at least part of an inner surface of said insertion portion forms said guide surface.

8. The connector according to claim 6, wherein said pivotal movement support portion has an elongate shape, a width of said intrusion groove is larger than a transverse direction of said pivotal movement support portion, and is smaller than a longitudinal dimension of said pivotal movement support portion, said fitting hole has a diameter substantially equal to said longitudinal dimension, and in said range of pivotal operation of said lever, the direction of said longitudinal dimension does not coincide with a direction of extending of said intrusion groove.

9. The connector structure comprising: a connector as defined in claim 6, and a mating connector which includes a housing for fitting in a body housing of said connector and an engagement portion for engagement with an engagement portion of said lever, wherein said engagement portions are so constructed that when said lever is pivotally operated, with said two engagement portions engaged with each others, said housing of said mating connector and said body housing are be fitted together with a fitting force larger than a force of pivotal movement of said lever.

10. The connector according to claim 3, wherein an insertion portion, into which said guided portion is inserted in a direction parallel to a direction of intrusion of said pivotal movement support portion into said intrusion groove, is provided at said body housing, and at least part of an inner surface of said insertion portion forms said guide surface.

11. The connector according to claim 10, wherein said pivotal movement support portion has an elongate shape, a width of said intrusion groove is larger than a transverse direction of said pivotal movement support portion, and is smaller than a longitudinal dimension of said pivotal movement support portion, said fitting hole has a diameter substantially equal to said longitudinal dimension, and in said range of pivotal operation of said lever, the direction of said longitudinal dimension does not coincide with a direction of extending of said intrusion groove.

12. The connector structure comprising: a connector as defined in claim 11, and a mating connector which includes a housing for fitting in a body housing of said connector and an engagement portion for engagement with an engagement portion of said lever, wherein said engagement portions are so constructed that when said lever is pivotally operated, with said two engagement portions engaged with each others, said housing of said mating connector and said body housing are be fitted together with a fitting force larger than a force of pivotal movement of said lever.

13. The connector according to claim 10, wherein said body housing includes a terminal holding portion, holding connector terminals and a hood portion surrounding said terminal holding portion, and said insertion portion is formed between said terminal holding portion and said hood portion.

14. The connector according to claim 13, wherein said pivotal movement support portion has an elongate shape, a width of said intrusion groove is larger than a transverse direction of said pivotal movement support portion, and is smaller than a longitudinal dimension of said pivotal movement support portion, said fitting hole has a diameter substantially equal to said longitudinal dimension, and in said range of pivotal operation of said lever, the direction of said longitudinal dimension does not coincide with a direction of extending of said intrusion groove.

15. The connector structure comprising: a connector as defined in claim 13, and a mating connector which includes a housing for fitting in a body housing of said connector and an engagement portion for engagement with an engagement portion of said lever, wherein said engagement portions are so constructed that when said lever is pivotally operated, with said two engagement portions engaged with each others, said housing of said mating connector and said body housing are be fitted together with a fitting force larger than a force of pivotal movement of said lever.

16. The connector according to claim 1, wherein said lever has an arcuate guided surface lying on a circle having a center thereof disposed on an axis of pivotal movement of said lever, and said guide portion is provided at such a position that said guide portion is disposed in sliding contact with said guided surface during the pivotal movement of said lever.

17. The connector according to claim 16, wherein said pivotal movement support portion has an elongate shape, a width of said intrusion groove is larger than a transverse direction of said pivotal movement support portion, and is smaller than a longitudinal dimension of said pivotal movement support portion, said fitting hole has a diameter substantially equal to said longitudinal dimension, and in said range of pivotal operation of said lever, the direction of said longitudinal dimension does not coincide with a direction of extending of said intrusion groove.

18. The connector structure comprising: a connector as defined in claim 16, and a mating connector which includes a housing for fitting in a body housing of said connector and an engagement portion for engagement with an engagement portion of said lever, wherein said engagement portions are so constructed that when said lever is pivotally operated, with said two engagement portions engaged with each others, said housing of said mating connector and said body housing are be fitted together with a fitting force larger than a force of pivotal movement of said lever.

19. The connector according to claim 1, wherein said pivotal movement support portion has an elongate shape, a width of said intrusion groove is larger than a transverse direction of said pivotal movement support portion, and is smaller than a longitudinal dimension of said pivotal movement support portion, said fitting hole has a diameter substantially equal to said longitudinal dimension, and in said range of pivotal operation of said lever, the direction of said longitudinal dimension does not coincide with a direction of extending of said intrusion groove.

20. The connector structure comprising: a connector as defined in claim 19, and a mating connector which includes a housing for fitting in a body housing of said connector and an engagement portion for engagement with an engagement portion of said lever, wherein said engagement portions are so constructed that when said lever is pivotally operated, with said two engagement portions engaged with each others, said housing of said mating connector and said body housing are be fitted together with a fitting force larger than a force of pivotal movement of said lever.

* * * * *